US006036792A

United States Patent [19]

Chu et al.

[11] Patent Number: 6,036,792

[45] Date of Patent: Mar. 14, 2000

[54] LIQUID-STATE-IN-SITU-FORMED CERAMIC PARTICLES IN METALS AND ALLOYS

[75] Inventors: Men Glenn Chu, Export; Siba P. Ray, Murrysville, both of Pa.

[73] Assignee: Aluminum Company of America, Pittsburgh, Pa.

[21] Appl. No.: 09/053,033

[22] Filed: Apr. 1, 1998

Related U.S. Application Data

[63] Continuation-in-part of application No. 08/594,966, Jan. 31, 1996, Pat. No. 5,735,976.

[51] Int. Cl.[7] ..... C22C 21/00

[52] U.S. Cl. ..... 148/437; 148/538; 148/549; 75/368; 428/614

[58] Field of Search ..... 148/437, 538, 148/549; 75/368; 428/614

[56] References Cited

U.S. PATENT DOCUMENTS

| | | | |
|---|---|---|---|
| 3,144,323 | 8/1964 | Watson et al. | 75/67 |
| 3,459,515 | 8/1969 | Bergmann | 29/182.8 |
| 4,748,001 | 5/1988 | Banerji et al. | 420/528 |
| 4,808,372 | 2/1989 | Koczak et al. | 420/457 |
| 4,820,339 | 4/1989 | Bienvenu et al. | 75/0.5 BB |
| 4,842,821 | 6/1989 | Banerji et al. | 420/528 |
| 4,885,130 | 12/1989 | Claar et al. | 419/12 |
| 4,915,908 | 4/1990 | Nagel et al. | 420/590 |
| 4,917,964 | 4/1990 | Moshier et al. | 428/614 |
| 5,041,263 | 8/1991 | Sigworth | 420/552 |
| 5,104,616 | 4/1992 | Backerud et al. | 420/552 |
| 5,401,338 | 3/1995 | Lin | 148/538 |
| 5,405,427 | 4/1995 | Eckert | 75/308 |
| 5,421,087 | 6/1995 | Newkirk et al. | 29/897.2 |
| 5,735,976 | 4/1998 | Chu et al. | 148/437 |

*Primary Examiner*—Patrick Ryan
*Assistant Examiner*—M. Alexandra Elve
*Attorney, Agent, or Firm*—David W. Pearce-Smith; Douglas G. Glantz

[57] ABSTRACT

A novel product composed of a ceramic phase particle dispersoid in metal, including uniformly distributed, finely sized carbide phase particles formed in situ in a molten metal and a novel method for producing such a ceramic phase particle dispersoid in metal are disclosed. A salt-based liquid state reaction involving a liquid metal/alloy containing a liquid Ti, B, Si, Sc, Hf, Nb, Ta, Zr, Mo, Al (when the molten metal matrix is not aluminum), or V and a halide salt containing carbon particles forms a uniform distribution of finely sized ceramic phase particles formed and dispersed in-situ in the metal matrix. The ceramic dispersoid in metal product of the present invention includes at least about 50 volume percent of a matrix metal of aluminum; and up to about 50 volume percent of a uniform distribution of finely sized ceramic phase particles formed and dispersed in-situ in the aluminum metal matrix, wherein the finely sized ceramic phase particles have an average particle diameter of less than about 2.5 microns, and wherein the uniform distribution consists of a substantially cluster-free distribution of no more than two particles attached to one another at a magnification of 500X.

24 Claims, 1 Drawing Sheet

LIQUID-STATE-IN-SITU-FORMED CERAMIC PARTICLES IN METALS AND ALLOYS

This patent application is a continuation-in-part of prior, U.S. patent application Ser. No. 08/594,966, filed Jan. 31, 1996, now U.S. Pat. No. 5,735,976 issued Apr. 7, 1998.

BACKGROUND OF THE INVENTION

1. Technical Field

The present invention relates to a composition containing uniformly dispersed, finely sized, liquid-state-in-situ-formed ceramic particles in metal and metal alloys, and to products containing the uniformly dispersed, finely sized ceramic particles formed in metal and metal alloys by the liquid-state in-situ process of the present invention. In one aspect, the present invention relates to a composition containing uniformly dispersed, finely sized, liquid-state-in-situ-formed titanium carbide particles in aluminum and aluminum alloys, and to products containing the uniformly dispersed, finely sized titanium carbide particles formed in aluminum and aluminum alloys by the liquid-state in-situ process of the present invention.

2. Background

The aluminum and aerospace industries have long sought a method to control recrystallization of aluminum alloys during deformation operations to permit the design of aluminum airframes with improved structural properties.

The metals industry today conventionally uses dispersoids, i.e., fine particles dispersed in the metal alloy, to control recrystallization and to increase dispersion strengthening at elevated temperatures. Such dispersoids of fine particles dispersed in the metal alloy usually are formed by solid state precipitation.

Recent developments in this area suggest that to improve formability and high temperature strength of aluminum alloys, it is necessary to increase the number densities and to reduce the size of the fine particle size dispersoids.

Conventional processes have the ability to form only a limited level of particle number density, because the number density of the dispersoid is determined by the initial dispersoid forming elements content as limited by its equilibrium solubility in liquid metal during solidification. For example, at the typical solidification rate in the range of about 0.05° C./sec to 20° C./sec, the maximum solubility of zirconium in aluminum is about 0.12 wt. percent, which is considered to be entirely too low for processing at higher temperatures and to form preferred structural properties. Accordingly, a process having the ability to form higher level number densities of stable particle is desired.

In the aluminum industry, dispersoid-forming elements such as Mn, Zr, Cr, V, Ti, Sc, and Hf are added to aluminum to increase the resistance to the recrystallization and increase the recrystallization temperature and to control the grain structure in cast and wrought products. Conventionally, different methods have been employed to add these dispersoid-forming types of alloying elements to molten aluminum metal. Historically, master alloys containing the desired elements have been added directly to the melt in the forms of a solid lump or bar.

The alloying elements in the master alloys normally are present in the form of coarse intermetallics, and these intermetallics require superheat and a long period of holding time to be dissolved in the melt. The heavy intermetallics also tend to settle to the bottom of the holding furnace by force of gravity. For this reason, the master alloys generally are added at a process location up-stream from the molten metal filters so that any coarse intermetallics which do not dissolve in the furnace can be removed prior to casting. If these coarse intermetallics are not filtered out of the molten metal, they adversely affect the mechanical properties of the solidified material. Removal of intentional alloying additions is inefficient and expensive. Perhaps more importantly, however, coarse intermetallic particles do not provide the preferred metallurgical benefits provided by the finer dispersoid particles.

Silicon carbide and alumina are the most commonly used reinforcement particulates. Certain emerging technologies are capable of producing fine particulates of different types with somewhat improved interfacial characteristics. Among the several ways of producing these materials, the technologies where the particles are introduced or formed in the molten aluminum prior to its solidification are attractive, primarily because of the potential for commercially economic processes on a large scale.

A variety of processing routes classified generally as in-situ ceramic phase formation processes in metal have been developed recently. According to the state of the reactants in the process, such a ceramic phase formation process in metal generally is classified into one of several categories:

(1) liquid metal—gas reaction, (2) liquid metal—liquid metal reaction, or (3) liquid—solid reaction.

In the case of carbon particles or carbon blocks in the context of liquid metal—liquid metal reactions or liquid—solid reactions, it is known that such carbon particles or carbon black are difficult to introduce directly into a melt in metal because of non-wetting of the carbon by the molten metal or alloy.

INTRODUCTION TO THE INVENTION

Recent developments in liquid metal—gas reaction processes have produced fine TiC particulates in a molten aluminum alloy. In this approach, a carbonaceous gas is introduced into an aluminum melt containing titanium to form TiC particulates, and the carbide volume fraction is determined by the initial titanium content. When the melt containing the carbides is cast and subsequently extruded for microstructure and property evaluation, the as-cast microstructure of the in-situ processed composites reveals a relatively uniform distribution of TiC particles with an average size of a few microns. No preferential particle segregation is observed in the dendritic cell boundaries generally.

U.S. Pat. No. 4,808,372, issued to Koczak et al., discloses an in-situ process for producing a composite containing refractory material. A molten composition, comprising a matrix liquid, and at least one refractory carbide-forming component are provided, and a gas is introduced into the molten composition. Methane is bubbled through a molten composition of powdered aluminum and powdered tantalum to produce a carbide having an average particle size in the fine mode of about 3 to 7 $\mu$m and in the coarse mode of about 35 $\mu$m.

Although conventional ceramic phase formation processes in metal offer some possibilities for the production of a wide range of reinforcement particle types and improved compatibility between the reinforcement and the matrix, the in-situ formed ceramic particles in metal are too large, e.g., on the order of several microns, and tend to form clusters. In-situ formed ceramic particles having these sizes, i.e., of several microns, are candidates for use as reinforcement in a composite, but are not suitable for use as dispersoids for recrystallation control, for dispersion strengthening, or for use as a component for structure refinement.

Accordingly, a novel ceramic dispersoid in metal product and process for making such a novel ceramic dispersoid in metal product are needed for providing uniformly dispersed, finely sized ceramic phase particles dispersed in-situ in a metal matrix.

U.S. Pat. No. 4,842,821 and U.S. Pat. No. 4,748,001, issued to Banerji et al., disclose a method for producing a metal melt containing dispersed particles of titanium carbide. Carbon particles are reacted with titanium in the metal to obtain titanium carbide. Banerji discloses that salts preferably are entirely absent from the melt (U.S. Pat. No. 4,842,821 Col. 3, lines 26–28, and U.S. Pat. No. 4,748,001 Col. 3, lines 40–42). The Banerji reference discloses a salt containing titanium ($K_2TiF_6$) as opposed to a component mixture of a salt together with carbon particles.

U.S. Pat. No. 5,405,427, issued to Eckert, discloses a flux composition for purifying molten aluminum to remove or capture inclusions in the melt and carry such inclusions to the surface (Col. 4, line 13 et seq.). The flux composition contains sodium chloride, potassium chloride, and a minor amount of magnesium chloride and carbon particles.

U.S. Pat. No. 5,401,338, issued to Lin, discloses a process for making metal matrix composites wherein fine particles (0.05 $\mu$m) of alumina, silicon nitride, silicon carbide, titanium carbide, zirconium oxide, boron carbide, or tantalum carbide are added into a metal alloy matrix (Col. 2, lines 64–68).

U.S. Pat. No. 5,041,263, issued to Sigworth, discloses a process for providing a grain refiner for an aluminum master alloy that contains carbon or other third elements and acts as an effective refiner in solution in the matrix, rather than being present as massive hard particles.

U.S. Pat. No. 4,917,964, issued to Moshier et al., discloses producing titanium carbide by induction heating a powder of titanium, carbon, and aluminum, i.e., in the form of a compact, to produce a concentrate of 60 wt. % titanium carbide in the form of a solid which is crushed. (Moshier Example 7, Col. 21–22.) The other Moshier actual examples, i.e., Examples 1–6 and 8, are similar, but use boron and not carbon. The Moshier additives are added as a solid phase powder, not as a liquid phase.

Uniformly high number densities of finely sized dispersoids increase the recrystallization temperature, inhibit grain growth in hot working, and improve elevated temperature strength. Further, fine particles of dispersoids are effective nuclei for grain refining.

It is against this need in the background technology that the present invention was made.

Accordingly, it is an object of this invention to provide aluminum alloys having high number densities of dispersoids.

Accordingly, it is an object of the present invention to provide a method for increasing the number densities of dispersoids in the liquid state and which then remain stable and dispersed in the solid state in metal alloys.

It is an object of the present invention to produce finely sized ceramic phase particles.

It is a further object of the present invention to produce uniformity in the dispersion of finely sized ceramic phase particles in metal and in alloys.

It is yet another object of the present invention to produce uniformly distributed, finely sized ceramic phase particles dispersed in-situ in a metal matrix.

It is another object of the present invention to produce uniformly distributed, finely sized ceramic phase particles dispersed in-situ in a metal alloy in a process providing reaction times shorter than conventional approaches.

It is another object of the present invention to produce uniformly distributed, finely sized ceramic phase particles dispersed in-situ in a metal alloy for recrystallization control, dispersion strengthening, or grain refining.

These and other objects of the present invention will become apparent from the detailed description which follows.

SUMMARY OF THE INVENTION

The present invention provides a novel method for producing a ceramic phase particle dispersoid in metal and a novel product composed thereof, including finely sized carbide phase particles formed in situ in a molten metal by a salt-based liquid state reaction with Ti, B, Si, Sc, V, Hf, Nb, Ta, Zr, Mo, or Al (when the molten metal matrix is not aluminum), and a halide salt containing fine carbon particles to form a uniform distribution of finely sized ceramic phase particles formed and dispersed in-situ in the metal matrix. The ceramic dispersoid in metal product of the present invention includes at least about 50 volume percent of a matrix metal of aluminum metal or aluminum alloy and up to about 50 volume percent of a uniform distribution of finely sized carbide ceramic phase particles formed and dispersed in-situ in the aluminum metal matrix, wherein the finely sized ceramic phase particles have an average particle diameter of less than about 2.5 microns, and wherein the uniform distribution consists of a substantially cluster-free distribution of no more than two particles attached to one another at a magnification of 500X.

DETAILED DESCRIPTION

Figure 1:
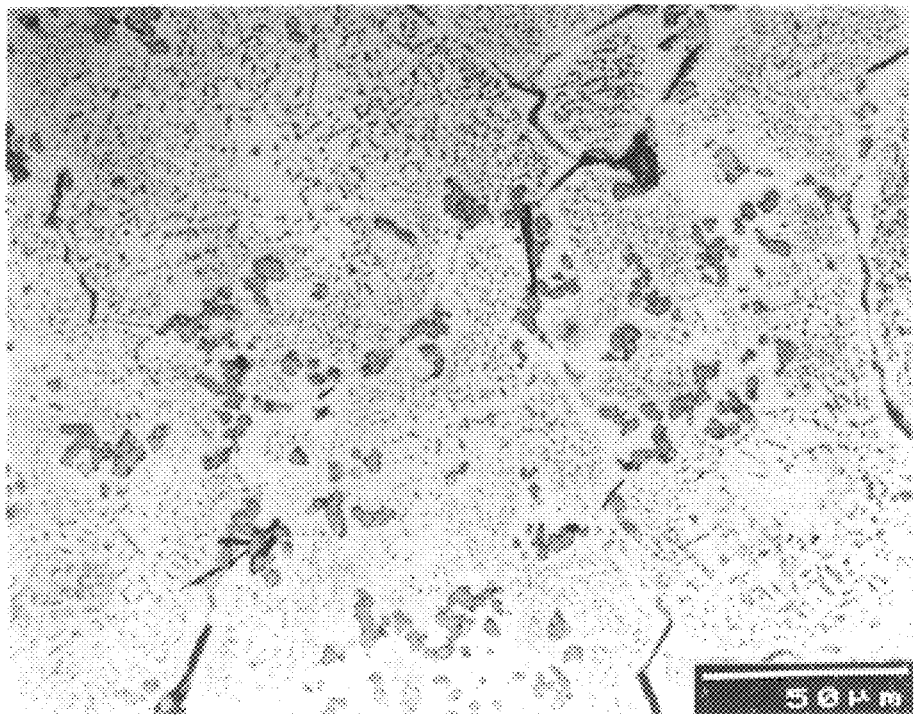
FIG. 1 shows a photomicrograph of ceramic second phase particles in metal as produced by conventional processes available in the prior art.

The present invention provides a novel liquid-state dispersoid-forming process, novel ceramic particle dispersoids formed in-situ in metal by the liquid-state process, and novel products containing the ceramic particle dispersoids formed in-situ in metal by the liquid-state process. In one aspect, the present invention provides a novel product and process for producing a material containing uniformly dispersed, finely sized ceramic phase particles, e.g., such as titanium carbide particles, formed in-situ in metal by the novel liquid-state dispersoid-forming process of the present invention.

The present invention provides a novel liquid-state-in-situ-formed ceramic dispersoid in metal product produced by the process of providing a molten composition, in one aspect, of molten aluminum metal/alloy and molten Ti metal, wherein the Ti metal is provided in molten composition as a liquid and not as a powder.

The significant difference of liquid and not powder is important to bring the components of titanium and carbon to reactive contact in the liquid state in the process of the present invention. A high density uniform dispersion of very small dispersoid particles is provided by the product formed by the process of the present invention.

The product of the present invention is very dense, e.g., on the order of 98% to 99% or higher. Porosity is undesirable in the product of the present invention. The importance of the high density, essentially non-porous product produced in accordance with the present invention is found in providing a porosity-free material for producing aluminum castings.

In one aspect, the novel ceramic dispersoid in metal product and process for producing such a ceramic dispersoid in metal include uniformly dispersed and finely sized carbide particles of the present invention formed in-situ in metal. In this one aspect, the present invention incorporates a novel mixing process involving the following two components:

(1) molten metal in combination with at least one of the carbide-forming elements including Ti, B, Si, Sc, V, Hf, Nb, Ta, Zr, Mo, and Al (when the molten metal matrix is not aluminum); and (2) salt containing fine carbon particles or dissolved carbon or a combination of fine carbon particles and dissolved carbon.

The present invention includes controlling and selecting the liquidus temperature of the salt to a value lower than that of the molten metal. The present invention further includes controlling and selecting the salt for the purpose of wetting the carbon particles.

The present invention includes a specific mixing process, wherein a first component of molten metal containing liquid carbide-forming elements is provided. A second component salt mixture containing carbon particles, either in the solid or in the dissolved state in the molten salt, initially is added to the first component of molten metal containing liquid carbide-forming elements. When both first and second components are in the liquid state, the melt is vigorously stirred mechanically or electromagnetically over a period of time. During the stirring, the molten second component salt mixture containing carbon particles is finely dispersed, and the process of the present invention provides for the carbon particles to react with the liquid carbide-forming element substantially instantaneously to form fine carbide particles. After reaction, the salt is decanted or removed.

The melt is then alloyed with any desirable alloying elements.

The alloy melt containing uniformly dispersed, finely sized carbide particles is then cast into a mold, or cast to form ingot (rectangular or round), slab, sheet, or strip. The alloy melt can be spray formed to form bulk product.

The molten salt used for the process of the present invention enhances the reaction of carbon and the liquid carbide-forming component in the liquid alloy. The molten salt provides that the alloy is cleaned of any oxide or dross and, hence, a fresh surface is available for reaction. Carbon has some small but finite solubility in the molten salt. As reaction proceeds, the salt is depleted with respect to carbon. Hence, more carbon is dissolved, and the dissolved carbon reacts with the carbide-forming element in the alloy to produce the fine particulates of carbides of the present invention. In accordance with the present invention, the carbon does not necessarily have to be dissolved in the molten salt for reaction to occur. Fine particulates of carbon also can take part in the reaction. Moreover, all of the carbon to be reacted need not be suspended in the salt at one time. Only a portion of the carbon need be in reactive contact, and when that carbon reacts, more carbon is brought into reaction contact by the vigorous stirring of the present invention.

The specific choice of salt composition in accordance with the present invention involves a molten salt containing elements which will not contaminate the metal by way of reacting with aluminum metal or aluminum alloying elements. The specific choice of salt composition in accordance with the present invention involves a salt which is thermodynamically stable and compatible with the metal. The present invention selects from the halide salts of alkali and alkaline earth metals. The halides of Na, K, Ca, Mg, and Li are preferred. Eutectic melts of binary, ternary, or quaternary salts with or without other additives may be used. The salt also preferably has a melting point below about 900° C. and, more preferably, below about 600° C. The eutectic melts of NaCl—KCl with small additions of $MgCl_2$ and $CaCl_2$ are particularly preferred. The NaCl and KCl weight/weight ratio should be about 1.0, preferably within 0.8–1.2. The additives of $MgCl_2$ and $CaCl_2$ preferably make up about 5–10% by weight of the salt mixture in accordance with the present invention.

In one aspect, the present invention employs a salt containing the following constituents and approximate percentages by weight, most preferably, NaCl: 48%, KCl: 48%, $MgCl_2$: 2.2%, and $CaCl_2$: 1.8%. This salt has a eutectic of about 600° C.–645° C., most preferably, of about 645° C.

The salt system of the present invention preferably has a eutectic capable of dissolving at a temperature below the liquidus of the metal matrix, e.g., in one aspect below the liquidus of aluminum is workable.

In addition, salts of $MgCl_2$—KCl, $MgCl_2$—NaCl, KCl—$CaCl_2$—NaCl also can be used in the system in accordance with the present invention. Salts having the specified eutectic composition and the specified melting points are preferred.

In addition, molten salts containing fluorides of Na, Ca, K, Mg, and Li can be used in the system in accordance with the present invention. When these fluoride salts are used, special care should be taken to provide that no excessive fluorides are evolved during the processing.

Although the process is described for carbides only, it can be extended to borides, nitrides, and similar such refractory material compounds having relatively high melting temperatures and hardness, and relatively low chemical reactivity in comparison to non-refractory materials.

The present invention provides for the formation of fine carbide particles in metal. The particles produced in situ in metal in accordance with the present invention are well-dispersed in the metal.

It has been found that the product formed by the process of the present invention provides a uniform distribution of fine particles wherein the particles have an average particle size less than about 2.5 microns, preferably less than 1 micron, and more preferably less than 0.3 micron, wherein the uniform distribution is in the form of a substantially cluster-free product. By cluster free is meant no more than 2 particles attached to one another as viewed at a magnification of 500X.

The process in accordance with the present invention includes mixing a molten metal of a liquid carbide-forming element with a low liquidus temperature salt containing fine carbon particles or dissolved carbon. Both components are brought to reactive contact in the liquid state and thoroughly mixed. After reaction of carbon with carbide-forming element, the salt is decanted or removed. The melt which contains uniformly distributed, finely sized, unagglomerated carbide particles is cast into a mold or cast to form ingot and the like.

Referring now to FIG. 1, a section of casting is shown in microstructure by actual photomicrograph. Ceramic second phase particles in metal as produced by conventional processes available in the prior art are shown. Large size particles in uneven dispersion are apparent.

Figure 2:
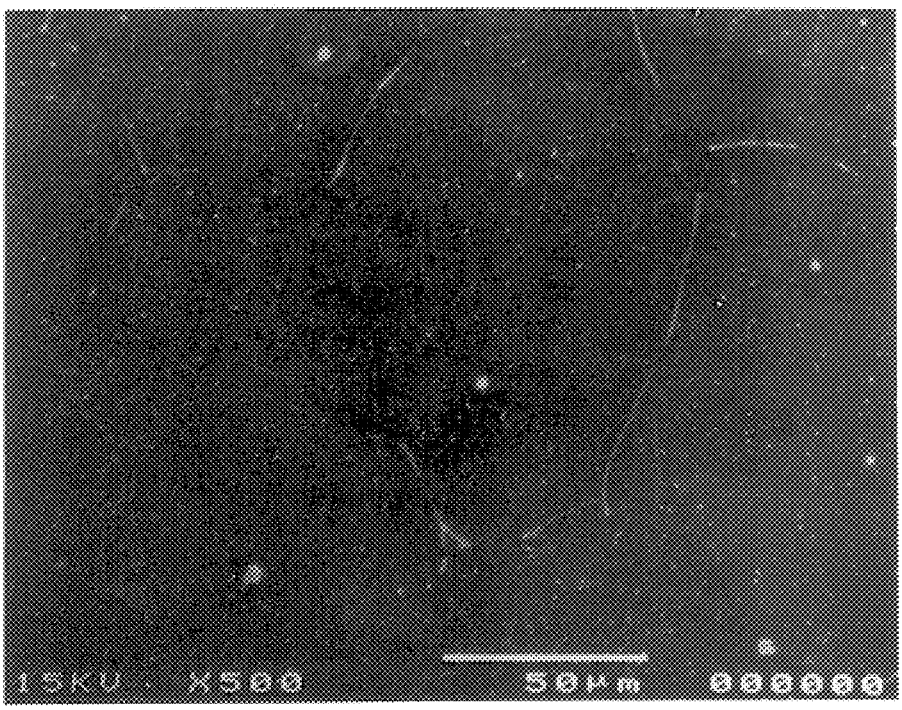
FIG. 2 shows a photomicrograph of a ceramic dispersoid in metal as produced and provided by the present invention.

Referring now to FIG. 2, a section is shown of the uniformly dispersed, finely sized titanium carbide particles formed in situ in aluminum in accordance with the present invention. The dispersoid particles are observed in microstructure to be finely sized with an average particle diameter less than about 0.3 microns and can be seen to be uniformly dispersed throughout the metal.

It has been found empirically that the present invention produces uniformly dispersed, finely sized ceramic phase particles formed and dispersed in-situ in a metal matrix. It has been found further that the present invention produces uniformly dispersed, finely sized ceramic phase particles formed and dispersed in-situ in a metal matrix in a process requiring reaction times shorter than existing conventional approaches, e.g., on the order of less than about one hour. The uniformly dispersed, finely sized ceramic phase particles dispersed in-situ in a metal matrix are suitable for applications for recrystallization control, dispersion strengthening, and grain refining.

EXAMPLE

A first component melt of 1.5 Kg of aluminum—2% titanium (1016 grams Al, 484 grams Ti) provided by the Aluminum Company of America, Alcoa Technical Center, Alcoa Center, Pa. was prepared and heated to about 983° C. A second component mixture (922 grams total) of carbon particles and a salt (700 grams) containing about 48% NaCl, 48% KCl, 2.2% $MgCl_2$, and 1.8% $CaCl_2$ by weight was prepared and heated to about 200° F. overnight. The preheated first and second components were added together in a crucible and heated to a temperature of about 983° C.

A mechanical stirring was applied by graphite propeller inserted into the crucible. A lid was placed to cover the crucible during reaction and to permit insertion of the graphite propeller and a thermocouple. After vigorous stirring and reaction for 15 minutes, the salt was skimmed, and the melt was cast into 1.5 inch diameter graphite molds. After cooling, the casting was cut for characterization.

The structure of the casting is shown in FIG. 2. As shown, the fine TiC particles are as small as submicrons in size and uniformly dispersed in the matrix.

The micro-composite particles of TiC in accordance with the present invention increase the ambient temperature strength and the elastic modulus of the aluminum base alloy.

The ceramic dispersoid in metal product of the present invention includes at least about 50 volume percent of a matrix metal of aluminum and up to about 50 volume percent of a uniform distribution of finely sized titanium carbide ceramic phase particles formed and dispersed in-situ in the aluminum metal matrix, wherein the finely sized ceramic phase particles have an average particle diameter of less than about 2.5 microns, and wherein the uniform distribution consists of a cluster free distribution of no more than two particles attached to one another at a magnification of 500X.

The finely sized ceramic phase titanium carbide particles can have an average particle diameter of less than about 1 micron formed and dispersed in situ in the aluminum metal matrix.

In one aspect, less than about 40 volume percent of a uniform distribution of finely sized titanium carbide ceramic phase particles are formed and dispersed in-situ in the aluminum metal matrix.

The finely sized ceramic phase particles can have an average particle diameter of less than about 0.3 micron formed and dispersed in situ in the aluminum metal matrix.

In one aspect, less than about 30 volume percent of a uniform distribution of finely sized titanium carbide ceramic phase particles are formed and dispersed in-situ in the aluminum metal matrix.

The ceramic dispersoid in metal product is formed by the process of providing the metal matrix in a liquid state containing liquid titanium and reacting a salt bath containing carbon with the liquid titanium element to form the uniform distribution of finely sized titanium carbide ceramic phase particles formed and dispersed in-situ in the aluminum metal matrix. The reacting step further includes vigorously stirring to form a mixture of the liquid titanium in contact with a portion of the carbon particles at an elevated temperature for sufficient residence time to form the uniform distribution of finely sized titanium the liquid titanium in contact with a portion of the carbon particles at an elevated temperature for sufficient residence time to form the uniform distribution of finely sized titanium carbide ceramic phase particles formed and dispersed in-situ in the metal matrix.

The ceramic dispersoid in metal product is formed by a method of forming finely sized carbide phase particles formed in situ in a molten metal or metal alloy, including (a) providing a molten matrix liquid of molten metal or metal alloy containing a carbide-forming liquid of Ti; (b) providing a halide salt containing carbon particles; and (c) reacting the halide salt containing carbon particles in the molten metal or metal alloy with the carbide-forming liquid to form a uniform distribution of finely sized ceramic phase particles formed and dispersed in-situ in a metal matrix. The step of reacting the halide salt containing carbon particles in the molten metal or metal alloy includes vigorously stirring the molten matrix liquid and the halide salt containing carbon particles to form a mixture of the carbide-forming liquid in contact with a portion of the carbon particles at an elevated temperature for sufficient residence time to form a uniform distribution of finely sized ceramic phase particles formed and dispersed in-situ in a metal matrix. metal matrix. In one aspect, less than about 0.5 volume percent of a uniform distribution of finely sized titanium carbide ceramic phase particles are formed and dispersed in-situ in the aluminum metal matrix.

The ceramic dispersoid in metal product by process, includes (a) at least about 70 volume percent of a matrix metal of aluminum and (b) up to about 30 volume percent of a uniform distribution of finely sized titanium carbide ceramic phase particles formed and dispersed in-situ in the aluminum metal matrix, wherein the finely sized ceramic phase particles have an average particle diameter of less than about 2.5 microns, and wherein the uniform distribution consists of a substantially cluster-free distribution of no more than two particles attached to one another at a magnification of 500X, wherein the finely sized ceramic phase particles are formed and dispersed in-situ in the metal matrix by the process of (i) providing a molten composition consisting essentially of molten aluminum metal liquid and molten Ti metal liquid, wherein the molten Ti metal liquid is provided in the molten composition as a liquid and not as a powder; (ii) providing a chloride salt containing fine carbon particles; and (iii) reacting the chloride salt containing fine carbon particles in the molten aluminum metal liquid with the molten Ti metal liquid to form the uniform distribution of finely sized titanium carbide particles formed and dispersed in-situ in an aluminum metal matrix. The step of reacting the halide salt containing carbon particles in the molten metal or metal alloy includes vigorously stirring the molten matrix liquid and the halide salt containing carbon particles to form a mixture of the carbide-forming element in contact with a portion of the carbon particles at an elevated temperature for sufficient residence time to form a uniform distribution of finely sized ceramic phase particles formed and dispersed in-situ in a metal matrix. The process further includes controlling and selecting the salt to have a liquidus temperature lower than that of the molten aluminum metal. The process further includes the step of controlling and selecting the salt for the purpose of wetting the carbon particles. The residence time can be less than one hour.

The salt preferably includes halide salts of alkali and alkaline earth metals. In one aspect, the salt includes a eutectic melt of NaCl—KCl with minor amounts of $MgCl_2$ and $CaCl_2$. In one aspect, the salt has a melting point below about 600° C., a NaCl and KCl weight/weight ratio within the range of about 0.8–1.2, and the additives of $MgCl_2$ and $CaCl_2$ make up about 5–10% by weight of the salt mixture. The salt preferably has a eutectic of about 600° C.–700° C. Most preferably, the salt contains about 48% NaCl, 48% KCl, 2.2% $MgCl_2$, and 1.8% $CaCl_2$ by weight.

The preferred ceramic dispersoid in metal product by process, includes at least about 70 volume percent of a matrix metal of aluminum and up to about 30 volume percent of a uniform distribution of finely sized titanium carbide ceramic phase particles formed and dispersed in-situ in the aluminum metal matrix, wherein the finely sized ceramic phase particles have an average particle diameter of less than about 0.3 micron, and wherein the uniform distribution consists of a cluster free distribution of no more than two particles attached to one another at a magnification of 500X, wherein the finely sized ceramic phase particles are formed and dispersed in-situ in the metal matrix by the process of (a) providing a molten composition comprising a matrix liquid of molten aluminum or aluminum alloy metal and Ti; (b) providing a chloride salt containing carbon particles, wherein the salt comprises NaCl and KCl in a weight/weight ratio within the range of about 0.8–1.2 and of $MgCl_2$ and $CaCl_2$ in amounts comprising up to about 5–10% by weight of the salt mixture; and (c) reacting the chloride salt containing carbon particles in the molten matrix liquid of molten metal by vigorously stirring the molten matrix liquid and the chloride salt containing carbon particles to form a mixture of the carbide-forming element in contact with a portion of the carbon particles at an elevated temperature above about 980° C. for a residence time less than one hour to form a uniform distribution of finely sized ceramic phase particles having an average particle diameter of less than about 0.3 microns formed and dispersed in-situ in an aluminum or aluminum alloy metal matrix.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

What is claimed is:

1. A ceramic dispersoid in metal product, comprising:

(a) at least about 50 volume percent of a matrix metal of aluminum; and (b) up to about 50 volume percent of a uniform distribution of finely sized titanium carbide ceramic phase particles formed and dispersed in-situ in said aluminum metal matrix, wherein said finely sized ceramic phase particles have an average particle diameter of less than about 2.5 microns, and wherein said uniform distribution consists of a substantially cluster-free distribution of no more than two particles attached to one another at a magnification of 500X, wherein said ceramic dispersoid in metal product is formed by the process of providing said metal matrix in a liquid state containing liquid titanium and reacting a salt bath containing carbon with said liquid titanium element to form said uniform distribution of finely sized titanium carbide ceramic phase particles formed and dispersed in-situ in said aluminum metal matrix.

2. The ceramic dispersoid in metal product as set forth in claim 1, wherein said finely sized ceramic phase particles comprise titanium carbide particles having an average particle diameter of less than about 1 micron formed and dispersed in situ in said aluminum metal matrix.

3. The ceramic dispersoid in metal product as set forth in claim 2, comprising up to about 40 volume percent of a uniform distribution of finely sized titanium carbide ceramic phase particles formed and dispersed in-situ in said aluminum metal matrix.

4. The ceramic dispersoid in metal product as set forth in claim 3, wherein said finely sized ceramic phase particles comprise titanium carbide particles having an average particle diameter of less than about 0.3 micron formed and dispersed in situ in said aluminum metal matrix.

5. The ceramic dispersoid in metal product as set forth in claim 4, comprising up to about 30 volume percent of a uniform distribution of finely sized titanium carbide ceramic phase particles formed and dispersed in-situ in said aluminum metal matrix.

6. The ceramic dispersoid in metal product as set forth in claim 1 comprising up to about 40 volume percent of a uniform distribution of finely sized titanium carbide ceramic phase particles formed and dispersed in-situ in said aluminum metal matrix.

7. The ceramic dispersoid in metal product as set forth in claim 6, wherein said reacting step comprises vigorously stirring to form a mixture of said liquid titanium in contact with a portion of said carbon particles at an elevated temperature for sufficient residence time to form said uniform distribution of finely sized titanium carbide ceramic phase particles formed and dispersed in-situ in said metal matrix.

8. A ceramic dispersoid in metal product as set forth in claim 1 formed by a method of forming finely sized carbide phase particles formed in situ in a molten metal or metal alloy, comprising:

(a) providing a molten matrix liquid of molten metal or metal alloy containing a carbide-forming liquid of Ti;

(b) providing a halide salt containing carbon particles; and (c) reacting said halide salt containing carbon particles in said molten metal or metal alloy with said carbide-forming liquid to form a uniform distribution of finely sized ceramic phase particles formed and dispersed in-situ in a metal matrix.

9. A ceramic dispersoid in metal product as set forth in claim 8 formed by the method wherein said step of reacting said halide salt containing carbon particles in said molten metal or metal alloy comprises vigorously stirring said molten matrix liquid and said halide salt containing carbon particles to form a mixture of said carbide-forming liquid in contact with a portion of said carbon particles at an elevated temperature for sufficient residence time to form a uniform distribution of finely sized ceramic phase particles formed and dispersed in-situ in a metal matrix.

10. A ceramic dispersoid in metal product as set forth in claim 1, comprising less than about 10 volume percent of a uniform distribution of finely sized titanium carbide ceramic phase particles formed and dispersed in-situ in said aluminum metal matrix.

11. A ceramic dispersoid in metal product as set forth in claim 1, comprising less than about 5 volume percent of a uniform distribution of finely sized titanium carbide ceramic phase particles formed and dispersed in-situ in said aluminum metal matrix.

12. A ceramic dispersoid in metal product as set forth in claim 1, comprising less than about 0.5 volume percent of a uniform distribution of finely sized titanium carbide ceramic phase particles formed and dispersed in-situ in said aluminum metal matrix.

13. A ceramic dispersoid in metal product by process, comprising:

(a) at least about 70 volume percent of a matrix metal of aluminum; and (b) up to about 30 volume percent of a uniform distribution of finely sized titanium carbide ceramic phase particles formed and dispersed in-situ in said aluminum metal matrix, wherein said diameter of less than about 2.5 microns, and wherein said uniform distribution consists of a substantially cluster-free distribution of no more than two particles attached to one another at a magnification of 500X, wherein said finely sized ceramic phase particles are formed and dispersed in-situ in said metal matrix by the process of:

(i) providing a molten composition consisting essentially of molten aluminum metal liquid and molten Ti metal liquid, wherein said molten Ti metal liquid is provided in said molten composition as a liquid and not as a powder;

(ii) providing a chloride salt containing fine carbon particles; and (iii) reacting said chloride salt containing fine carbon particles in said molten aluminum metal liquid with said molten Ti metal liquid to form said uniform distribution of finely sized titanium carbide particles formed and dispersed in-situ in an aluminum metal matrix.

14. The ceramic dispersoid in metal product by process as set forth in claim 13, wherein said step of reacting said halide salt containing carbon particles in said molten metal or metal alloy comprises vigorously stirring said molten matrix liquid and said halide salt containing carbon particles to form a mixture of said carbide-forming element in contact with a portion of said carbon particles at an elevated temperature for sufficient residence time to form a uniform distribution of finely sized ceramic phase particles formed and dispersed in-situ in a metal matrix.

15. The ceramic dispersoid in metal product by process as set forth in claim 13, wherein said finely sized titanium carbide ceramic phase particles comprise titanium carbide particles having an average particle diameter of less than about 0.3 microns formed in situ in metal.

16. The ceramic dispersoid in metal product by process as set forth in claim 13, said process further comprising (d) controlling and selecting said salt to have a liquidus temperature lower than that of said molten aluminum metal.

17. The ceramic dispersoid in metal product by process as set forth in claim 16, wherein said step of controlling and selecting said salt further comprises selecting said salt for the purpose of wetting said carbon particles.

18. The ceramic dispersoid in metal product by process as set forth in claim 17, wherein said residence time is less than one hour.

19. The ceramic dispersoid in metal product by process as set forth in claim 18, wherein said salt comprises halide salts of alkali and alkaline earth metals.

20. The ceramic dispersoid in metal product by process as set forth in claim 19, wherein said salt comprises a eutectic melt of NaCl—KCl with minor amounts of $MgCl_2$ and $CaCl_2$.

21. The ceramic dispersoid in metal product by process as set forth in claim 20, wherein said salt has a melting point below about 600° C., a NaCl and KCl weight/weight ratio within the range of about 0.8–1.2, and the additives of $MgCl_2$ and $CaCl_2$ comprise up about 5–10% by weight of the salt mixture.

22. The method as set forth in claim 21, wherein said salt has a eutectic of about 600° C.–700° C.

23. The method as set forth in claim 22, wherein said salt contains about 48% NaCl, 48% KCl, 2.2% $MgCl_2$, and 1.8% $CaCl_2$ by weight.

24. A ceramic dispersoid in metal product by process, comprising:

(a) at least about 70 volume percent of a matrix metal of aluminum; and (b) up to about 30 volume percent of a uniform distribution of finely sized titanium carbide ceramic phase particles formed and dispersed in-situ in said aluminum metal matrix, wherein said finely sized ceramic phase particles have an average particle diameter of less than about 0.3 micron, and wherein said uniform distribution consists of a cluster-free distribution of no more than two particles attached to one another at a magnification of 500X, wherein said finely sized ceramic phase particles are formed and dispersed in-situ in said metal matrix by the process of:

(a) providing a molten composition comprising a matrix liquid of molten aluminum or aluminum alloy metal and Ti;

(b) providing a chloride salt containing carbon particles, wherein said salt comprises NaCl and KCl in a weight/weight ratio within the range of about 0.8–1.2 and of $MgCl_2$ and $CaCl_2$ in amounts comprising up to about 5–10% by weight of the salt mixture; and (c) reacting said chloride salt containing carbon particles in said molten matrix liquid of molten metal by vigorously stirring said molten matrix liquid and said chloride salt containing carbon particles to form a mixture of said carbide-forming element in contact with a portion of said carbon particles at an elevated temperature above about 980° C. for a residence time less than one hour to form a uniform distribution of finely sized ceramic phase particles having an average particle diameter of less than about 0.3 microns formed and dispersed in-situ in an aluminum or aluminum alloy metal matrix.

* * * * *